US005564233A

United States Patent [19]

Norton

[11] Patent Number: 5,564,233

[45] Date of Patent: Oct. 15, 1996

[54] SLIDING DECORATIVE DENTIL STRUCTURE WITHIN CHANNEL

[75] Inventor: Ted Norton, Sandy, Utah

[73] Assignee: Aluma-Crown, Inc., Murray, Utah

[21] Appl. No.: 327,287

[22] Filed: Oct. 21, 1994

[51] Int. Cl.[6] ..... E04B 1/00; E04F 19/00

[52] U.S. Cl. ..... 52/60; 52/94; 52/95; 52/314; 52/312; 52/717.06; 52/287.1

[58] Field of Search ..... 52/287.1, 311.2, 52/312, 314, 316, 302.6, 94–96, 60, 730.1, 732.1, 732.2, 742.1, 742.12, 745.07, 745.08, 746.1, 748.11, 716.1, 716.8, 717.06

[56] References Cited

U.S. PATENT DOCUMENTS

| | | | |
|---|---|---|---|
| 460,718 | 10/1891 | Fritz | 52/94 |
| 650,125 | 5/1900 | Davies et al. | 52/314 |
| 851,932 | 4/1907 | Grossman | 52/717.06 |
| 866,479 | 9/1907 | Kiesel, Jr. | 52/312 |
| 1,142,253 | 6/1915 | Harris | 52/96 |
| 2,755,893 | 7/1956 | Male . | |
| 2,896,559 | 7/1959 | Stephens | 52/94 |
| 3,236,011 | 2/1966 | Orr | 52/96 X |
| 3,373,676 | 3/1968 | Dunnington et al. . | |
| 3,777,649 | 12/1973 | Luckey . | |
| 3,824,749 | 7/1974 | Scherf . | |
| 4,195,455 | 4/1980 | Chalmers et al. . | |
| 4,274,237 | 6/1981 | Hagstrom | 52/312 |
| 4,461,128 | 7/1984 | Knoebl . | |
| 4,483,112 | 11/1984 | Rueblinger . | |
| 4,658,552 | 4/1987 | Mulford . | |
| 4,709,518 | 12/1987 | Lane . | |
| 4,807,409 | 2/1989 | Sells . | |
| 4,843,783 | 7/1989 | Taravella . | |
| 4,995,308 | 2/1991 | Waggoner . | |
| 5,001,877 | 3/1991 | Edwards | 52/287.1 X |
| 5,088,252 | 2/1992 | Antekeier | 52/287.1 X |
| 5,195,283 | 3/1993 | MacLeod et al. . | |
| 5,292,281 | 3/1994 | Butler . | |
| 5,315,799 | 5/1994 | Cillinan | 52/287.1 X |

*Primary Examiner*—Robert Canfield
*Attorney, Agent, or Firm*—Thorpe, North & Western, L.L.P.

[57] ABSTRACT

A decorative siding structure for buildings. A series of dentil blocks is formed as a unitary one-piece dentil member. The dentil member is slidably engageable within a three-sided containment channel which is configured for secure attachment to a building. The scope of the invention also includes a frieze structure being integrally formed with the containment channel such that when the channel is securely attached to a building, the frieze extends upwardly and forwardly from the building so as to conceal a portion of a side of the building.

15 Claims, 1 Drawing Sheet

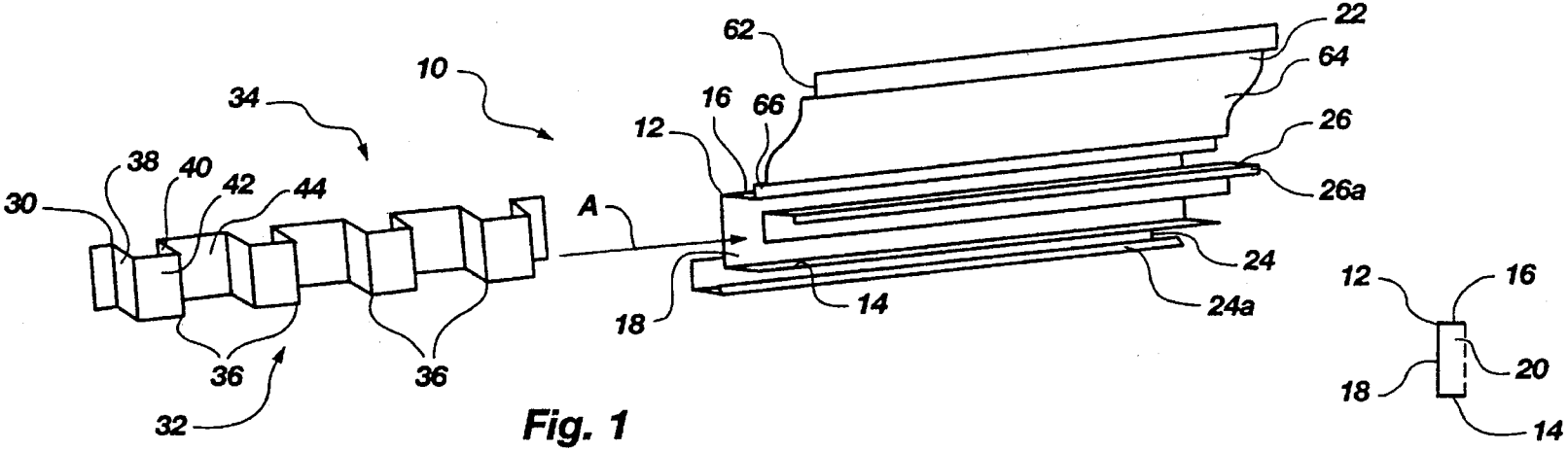
Fig. 1
Fig. 1A
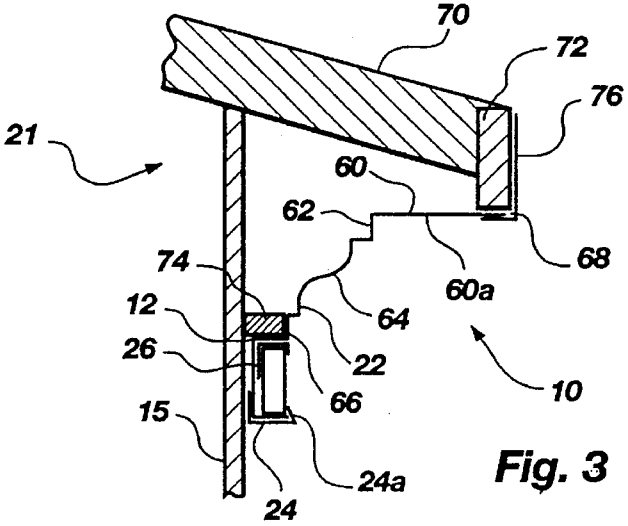
Fig. 3
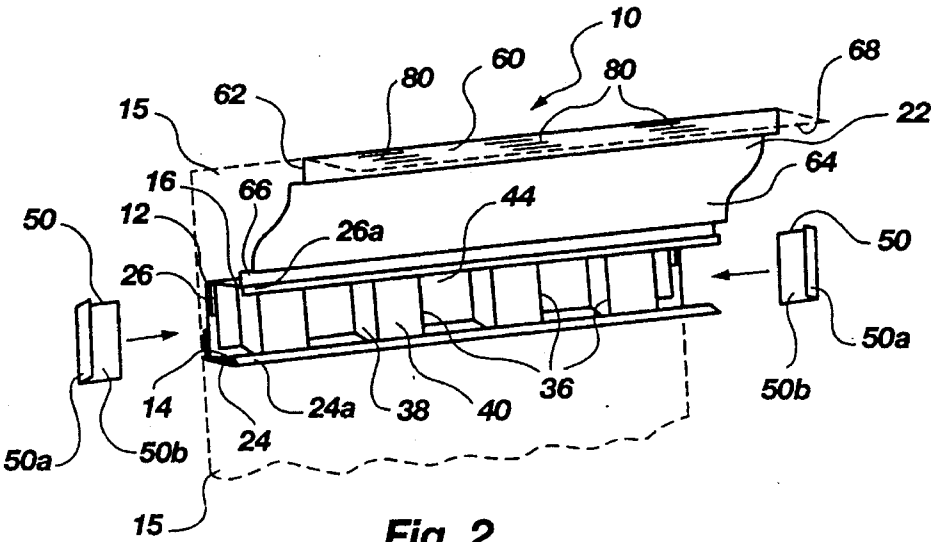
Fig. 2

SLIDING DECORATIVE DENTIL STRUCTURE WITHIN CHANNEL

BACKGROUND OF THE INVENTION

1. The Field of the Invention

The present invention relates generally to decorative siding structure for buildings, and more particularly to trim elements including a dentil piece slidably engaged within an integrated frieze and channel structure.

2. The Background Art

Trim materials have found widespread acceptance in the building industry for concealing portions of buildings such as door and window casings, fascia boards, moldings, cornices and the like. For example, frieze trim has been developed for placement against upper portions of buildings such as against fascia board or beneath eaves. Friezes are often referred to in the art as crowns. Vinyl siding is often used as trim structure in the form of soffits and fascia panels.

Dentil blocks have also been developed for decorative siding purposes. Dentils are separate decorative block members commonly secured in a horizontal line along the side of a house, such as against a fascia board or beneath an eave. However, each dentil block must be installed separately, which is laborious and time consuming. Extra time is required to ensure that the dentil blocks are straight and aligned. Of current interest is a combination frieze and dentil trim structure which is simple in design and easy to install accurately.

OBJECTS AND SUMMARY OF THE INVENTION

It is therefore an object of the present invention to provide decorative siding structure which is easier and less time-consuming to install accurately.

It is another object of the invention to provide such siding structure which utilizes fewer separate pieces.

The above objects and others not specifically recited are realized in a specific illustrative embodiment of a decorative siding structure for buildings. A series of dentil blocks is formed as a unitary one-piece dentil member. The dentil member is slidably engageable within a three-sided containment channel which is configured for secure attachment to a building. The scope of the invention also includes a frieze structure being integrally formed with the containment channel such that when the channel is securely attached to a building, the frieze extends upwardly and forwardly from the building so as to conceal a portion of a side of the building.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which:

FIG. 1 is an exploded perspective view of a dentil structure slidably engageable within a frieze-and-channel means made in accordance with the principles of the present invention;

FIG. 1A is a side view of a containment channel of FIG. 1;

FIG. 2 is an assembled perspective view of the structure of FIG. 1 with the additional of a soffit panel, in conjunction with an exploded depiction of a pair of retaining end caps; and FIG. 3 is a side, cross sectional view of the structure of FIG. 2 installed on a building.

DETAILED DESCRIPTION

A preferred embodiment in accordance with the present invention is illustrated in FIG. 1 wherein is shown a sliding dentil and channel siding structure, generally designated at 10. The siding structure 10 includes an elongate, three-sided containment channel 12 having first and second elongate side walls 14 and 16 of smaller width intercoupled by a third elongate side wall 18 of larger width. The containment channel 12 defines an enclosure area 20, shown most clearly in FIG. 1A. A frieze or crown 22 extends outwardly from the second side wall 16 of smaller width, such that the first, second and third side walls 12, 14 and 16 and the crown 22 collectively form a one-piece unitary member. When the containment channel 12 is securely attached to a wall 15 (shown in phantom line in FIG. 2) of a building 21 (FIG. 3), it is preferable for the crown 22 to extend upwardly and fowardly from the side wall 16 in a direction away from the wall 15 to thereby conceal a portion of a side of the wall.

Decorative siding means such as an elongate one-piece continuous dentil structure 30 having front and back portions generally designated at 32 and 34, respectively, is slidably engageable within the containment channel 12 as shown by arrow A in FIG. 1. It will be appreciated that the first, second and third side walls 12, 14 and 16 of the containment channel 12 operate to retain the dentil structure 30 in a secure, seated position. The dentil structure 30 may of course assume many different shapes and configurations. The dentil structure 30 preferably includes a series of hollow, volumetric rectangular dentil blocks 36 having first and second opposing side walls 38 and 40 of smaller width intercoupled by a front wall 42 of larger width to form at least a three-sided dentil block. The dentil blocks 36 are arranged in a straight-line configuration with side walls of each adjacent pair of dentil blocks being intercoupled by a separate connecting back wall 44. Most preferably, all of the front walls 42 of the dentil blocks 36 are substantially common to a first plane and all of the connecting back walls 44 are substantially common to a second plane.

The dentil structure 30 can be further secured by first and second elongate insert members 24 and 26, which include protruding elongate lip portions **24*a* and 26*a*, respectively. The first and second insert members 24 and 26 are configured for secure placement against the first and second side walls 14 and 16 of smaller width, respectively, as shown by the corresponding arrows in FIG. 1. The insert members 24 and 26 can be secured to the side walls with rivets or some other suitable fastening means. The dentil structure 30 is preferably configured and dimensioned so as to engage against the protruding lip portions 24*a* and 26*a* in a secure position when it is slidably inserted within the containment channel 12, with its back portion 34 facing the third side wall 18 of the containment channel 12. The back portion 34 of the dentil structure 30 may reside in a contacting contiguous position against the third side wall 18 of the containment channel 12**.

The insert members 24 and 26 are preferably secured in an opposing orientation, such that their respective lip portions 24*a* and 26*a* extend away from the first and second side walls 14 and 16, respectively, and at least partially toward each other as shown for example in FIG. 2. The side walls 14 and 16 of the containment channel 12 preferably form right angles relative to the third side wall 18, and the lip portions 24*a* and 24*b* of the insert members form angles with their respective contacting side walls 14 and 16 which are less than 180 degrees. It has been found advantageous to have at least one of the lip portions, for example the lip 24*a* of the first insert member 24, to extend inwardly into the enclosure area 20 to thereby form an acute angle with respect to its contacting side wall 14.

As shown in FIG. 2, additional structural security can be provided in the form of retaining members 50. Each retaining member 50 is comprised of a pair of sides 50*a* and 50*b*. The retaining members 50 are configured for secure engagement over free ends of the containment channel 12 and dentil structure 30 simultaneously, such that said free ends become sandwiched within the retaining members. When one or both insert members 24 and 26 are used, their free ends can also be sandwiched among the free ends of the containment channel 12 and dentil structure 30 within the retaining members 50. Installation of two opposing retaining members 50 as shown in FIG. 2 can inhibit slidable displacement of the dentil structure 30 in first and second opposing directions within the containment channel 12.

It will be appreciated that the one-piece unitary nature of the containment channel 12 makes it easier to align and install properly. Laborers must make markings such as chalk lines for each structural item to be fastened to a building to prevent a crooked or otherwise misaligned installation. Since the containment channel is a single piece, only one chalk line is necessary to install it. When the containment channel 12 includes the crown 22 formed thereon, the need for a separate chalk line to install the crown is thus also eliminated. It is to be understood that the crown 22 is optional; the containment channel 12 can be made without the crown 22 if it is desired simply to display the dentil structure 30.

The structure 10 may include a continuous soffit panel 60, shown in FIG. 3 and in phantom line in FIG. 2. The crown 22 and soffit panel 60 are related in that the soffit panel is connected along its length along an upper section 62 of the crown 22. The soffit panel is preferably part of the crown and channel structure so as to form a continuous portion thereof. The crown 22 preferably includes a curved central section 64 bounded by the upper and lower right-angle channel sections 62 and 66, respectively, such that a cross section of the curved central section 64 at any point thereof comprises a curvilinear line. The soffit panel 60 preferably has a substantially planer exterior surface 60*a* (FIG. 3) so as to extend horiztonally outward from the upper section 62 of the crown 22 in a direction away from the wall 15. The exterior surface 60*a* is thus preferably common to a horizontal plane.

The soffit panel 60 is configured for attachment at its distal edge 68 to a portion of a roof 70 of the building, such as fascia board 72. Most preferably, the lower section 66 of the crown 22 is secured to the wall 15 by attachment to a nailing block 74, and the soffit panel 60 is secured to the fascia board 72 with a fascia panel 76 as shown in FIG. 3.

The soffit panel 60 includes vent passages 80 (FIG. 2) formed therein for permitting air to pass through the soffit panel into and out of the building 21. The vent passages 80 may of course embody many different designs. It is to be understood that the phrase "vent passage" as used herein shall refer broadly to either a single opening or an array of openings or to any suitable venting concept. For example, each vent passage 80 comprises an array of individual openings, but may alternatively comprise a single slit. The vents may thus comprise a series of spaced-apart vent passages 80 formed in the soffit panel 60 including two opposing end vents and at least one interior vent as shown in FIG. 2. Each interior vent would then have two adjacent spaced-apart vent passages 80 on either side. The vent passages 80 may be replaced with a single elongate vent passage formed in the soffit panel 60 which extends along at least part of the length of the soffit panel.

The channel/crown/soffit siding structure 10 is preferably shaped from a single piece of sheet metal. It will be appreciated that the one-piece unitary nature of the structure 10 makes it easier to align and install properly and therefore results in lower installation costs without eliminating the vents 80. Only the single structural piece 10 need be installed on the building 20 (the fascia panel 29 is of course optional). There are fewer parts involved and thus less time required for installation. Laborers must make markings such as chalk lines for each structural item to be fastened to a building to prevent a crooked or otherwise misaligned installation. Since the crown-and-soffit siding structure 10 is a single piece, only one chalk line is necessary to install it.

It will be appreciated that the present invention can be formed by shaping and cutting a piece of the sheet metal. Of course, the invention could also be made by securing together separate pieces of metal or other suitable material. A preferred method of manufacturing the siding structure 10 in accordance with the present invention includes the following steps:

(a) selecting a single sheet of flexible metal;

(b) selectively bending a first section of the sheet to form therefrom an elongate crown means having opposing upper and lower sections and being configured for stationary placement relative to a building so as to extend outwardly from the building; and (c) selectively bending a second section of the sheet to form therefrom an elongate channel means configured for secure attachment to the building, said channel means including first and second opposing side wall means of smaller width intercoupled by third side wall means of larger width to form at least a three-sided containment channel.

The above steps may be augmented by the steps of:

(d) selectively bending a third section of the sheet to form therefrom an elongate soffit means connected along its length along the upper section of the crown means so as to extend outwardly from the crown means in a direction away from the building, wherein the crown means and the soffit means collectively form a one-piece unitary member from the metal sheet;

(e) forming venting means in the soffit means for permitting passage of air through the soffit means.

A preferred method of concealing part of a building in accordance with the present invention includes the steps of:

(a) affixing an elongate channel means to a building, said channel means including first and second opposing side wall means of smaller width intercoupled by third side wall means of larger width to form at least a three-sided containment channel; and (b) slidably engaging a one-piece elongate decorative siding means having front and back portions within the three-sided containment channel so as to reside therein in a secure position with its back portion facing the third side wall of larger width.

It will be appreciated that various modifications and alternative configurations of the exemplary siding structure 10 can be made in accordance with the principles of the present invention. Such changes may from time to time be made by those skilled in the relevant arts without departing from the spirit and scope of the invention as defined by the appended claims. For example, it will be appreciated from the preceding disclosure that the insert members 24 and 26 are optional, as are the retaining members 50. The dentil structure 30 can be slidably engaged within the containment channel 12 simply by resting against the first, second and third side walls 14, 16 and 18 thereof. Alternatively, it is also in accordance with the present invention to form the protruding lip portions 24*a* and 26*a* as an integral, part of the containment channel 12.

Those skilled in the art will appreciate that the scope of the present invention encompasses many combinations and a broad spectrum of features and structures equivalent to those specifically discussed herein. The principles of the invention may thus be used in any setting requiring the advantages thereof. Those having ordinary skill in the field of this invention will appreciate the advantages of the invention and its application to a wide variety of uses, and that objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A decorative siding structure for buildings comprising:

elongate channel means configured for secure attachment to a building, said channel means including first and second opposing side wall means intercoupled by third side wall means to form at least a three-sided containment channel; and siding means having front and back portions and being engageable within the three-sided containment channel so as to reside therein in a secure position with its back portion facing the third side wall means;

wherein the elongate channel means further comprises:

first and second elongate insert members each including a protruding lip portion and being configured for secure placement against the first and second side wall means, respectively, in an opposing orientation such that the lip portions of said first and second insert members extend away from said first and second side wall means, respectively, and at least partially toward each other.

2. A decorative siding structure as defined in claim 1, wherein the siding means is configured and dimensioned so as to engage against the protruding lip portions of the insert members in a secure position while its back portion faces the third side wall means.

3. A decorative siding structure as defined in claim 2, wherein the containment channel defines an enclosure area and wherein at least one of the protruding lip portions extends inwardly into the enclosure area to thereby form an acute angle with respect to the side wall means against which its insert member is placed.

4. A decorative siding structure as defined in claim 2, wherein at least part of the back portion of the siding means resides in a contacting contiguous position against the third side wall means of the containment channel when the siding means is engaged against the protruding lip portions of the insert members in a secure position.

5. A decorative siding structure for buildings comprising:

elongate channel means configured for secure attachment to a building, said channel means including first and second opposing side wall means intercoupled by third side wall means to form at least a three-sided containment channel; and sliding means having front and back portions and being engageable within the three-sided containment channel so as to reside therein in a secure position with its back portion facing the third side wall means, wherein the three-sided containment channel and the siding means each include first and second opposing ends;

first retaining means configured for secure engagement over the first end of the containment channel and the first end of the siding means simultaneously such that said first ends are both sandwiched within the first retaining means, to thereby inhibit slidable displacement of the siding means in a first direction within the containment channel; and second retaining means configured for secure engagement over the second end of the containment channel and the second end of the siding means simultaneously such that said second ends are both sandwiched within the second retaining means, to thereby inhibit slidable displacement of the siding means in a second direction within the containment channel.

6. A decorative siding structure for buildings comprising:

elongate crown-and-channel means configured for secure attachment to a building, said crown-and-channel means including:

first and second elongate opposing side walls of smaller width intercoupled by a third elongate side wall of larger width to form at least a three-sided containment channel which defines an enclosure area, and crown means extending outwardly from one of the side walls of smaller width, wherein the first, second and third side walls and the crown means collectively form a one-piece unitary member;

first and second elongate insert members each including a protruding lip portion and being configured for secure placement against the first and second side walls of smaller width, respectively, in an opposing orientation such that the lip portions of said first and second insert members extend away from said first and second side walls, respectively, and at least partially toward each other;

one-piece elongate decorative siding means having front and back portions and being slidably engageable within the three-sided containment channel so as to engage against the protruding lip portions of the insert members in a secure position with its back portion facing the third side wall of larger width.

7. A decorative siding structure as defined in claim 6, wherein the decorative siding means comprises an elongate one-piece continuous dentil structure.

8. A decorative siding structure as defined in claim 7, wherein the dentil structure comprises a series of hollow, volumetric rectangular dentil blocks having first and second opposing side walls of smaller width intercoupled by a front wall of larger width to form at least a three-sided dentil block, the dentil blocks being arranged in a straight-line configuration with side walls of each adjacent pair of dentil blocks being intercoupled by a separate connecting back wall, wherein all of the front walls of the dentil blocks are substantially common to a first plane and all of the connecting back walls are substantially common to a second plane.

9. A decorative siding structure as defined in claim 6 configured and dimensioned such that when the crown-and-channel means is securely attached to a building, the crown means extends upwardly and forwardly from said one of the side walls of smaller width in a direction away from the building to thereby conceal a portion of a side of the building.

10. A decorative siding structure as defined in claim 6, wherein at least part of the back portion of the one-piece elongate decorative siding means resides in a contacting contiguous position against the third side wall of larger width when the siding means is engaged against the protruding lip portions of the insert members in a secure position.

11. A decorative siding structure as defined in claim 10, wherein the three-sided containment channel and the one-piece elongate decorative siding means each include first and second opposing ends, said decorative siding structure further comprising:

first retaining means configured for secure engagement over the first end of the containment channel and the first end of the siding means simultaneously such that said first ends are both sandwiched within the first retaining means, to thereby inhibit slidable displacement of the siding means in a first direction within the containment channel; and second retaining means configured for secure engagement over the second end of the containment channel and the second end of the siding means simultaneously such that said second ends are both sandwiched within the second retaining means, to thereby inhibit slidable displacement of the siding means in a second direction within the containment channel.

12. A decorative siding structure as defined in claim 6, wherein at least one of the protruding lip portions extends inwardly into the enclosure area to thereby form an acute angle with respect to the side wall against which its insert member is placed.

13. A decorative siding structure as defined in claim 6 wherein the crown means includes opposing upper and lower sections, the siding structure further comprising:

elongate continuous soffit means connected along its length along the upper section of the crown means so as to extend outwardly from the crown means in a direction away from the building, wherein the containment channel, crown means and the soffit means collectively form a one-piece unitary member, said soffit means being configured for attachment to a roof portion of the building and including venting means formed therein for permitting passage of air through the soffit means into and out of the building.

14. A decorative siding structure as defined in claim 13, wherein the soffit means comprises a single soffit panel having a substantially planer exterior surface such that the soffit panel extends substantially horizontally outward from the upper section of the crown means to thereby cause the exterior surface of the soffit panel to reside substantially common to a horizontal plane.

15. A decorative siding structure as defined in claim 13, wherein the crown means further comprises a thin wall formed into a curved central section bounded by the upper and lower sections, such that a cross section of the curved central section at any point thereof comprises a curvilinear line.

* * * * *